US007086339B2

(12) United States Patent
Apps et al.

(10) Patent No.: US 7,086,339 B2
(45) Date of Patent: Aug. 8, 2006

(54) PALLET ASSEMBLY

(75) Inventors: William P. Apps, Alpharetta, GA (US); Justin M. Smyers, Redondo Beach, CA (US); Trenton M. Overholt, Manhattan Beach, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 326 days.

(21) Appl. No.: 10/426,335

(22) Filed: Apr. 29, 2003

(65) Prior Publication Data

US 2004/0216648 A1 Nov. 4, 2004

(51) Int. Cl.
*B65D 19/38* (2006.01)

(52) U.S. Cl. ..... 108/57.25

(58) Field of Classification Search ..... 108/57.25, 108/51.11, 901, 902
See application file for complete search history.

(56) References Cited

U.S. PATENT DOCUMENTS

| | | | | |
|---|---|---|---|---|
| 3,467,032 | A | 9/1969 | Rowlands et al. | |
| 3,628,468 | A | 12/1971 | Angelbeck, Jr. | |
| 3,710,733 | A | 1/1973 | Story | |
| 3,875,280 | A | 4/1975 | Story | |
| 3,938,448 | A | 2/1976 | Nishitani et al. | |
| 4,159,681 | A | 7/1979 | Vandament | |
| 4,183,491 | A | 1/1980 | Sanders et al. | |
| 4,316,419 | A | 2/1982 | Cupido | |
| 4,597,338 | A | 7/1986 | Kreeger | |
| 4,735,154 | A | 4/1988 | Hemery | |
| 5,117,762 | A * | 6/1992 | Shuert | 108/57.25 |
| 5,160,029 | A | 11/1992 | Pigott et al. | |
| 5,197,395 | A | 3/1993 | Pigott et al. | |
| 5,197,396 | A | 3/1993 | Breezer et al. | |
| 5,343,814 | A | 9/1994 | Pigott et al. | |
| 5,351,629 | A | 10/1994 | Breezer et al. | |
| 5,404,829 | A | 4/1995 | Shuert | |
| 5,408,937 | A | 4/1995 | Knight, IV et al. | |
| 5,413,052 | A | 5/1995 | Breezer et al. | |
| 5,687,532 | A | 11/1997 | Torrey | |
| 5,736,221 | A | 4/1998 | Hardigg et al. | |
| 5,758,855 | A | 6/1998 | Jordan et al. | |
| 5,791,262 | A * | 8/1998 | Knight et al. | 108/57.25 |
| 5,806,436 | A | 9/1998 | Weichenrieder, Sr. et al. | |
| 5,868,080 | A | 2/1999 | Wyler et al. | |
| 5,887,529 | A | 3/1999 | John et al. | |

(Continued)

FOREIGN PATENT DOCUMENTS

DE 3205910 A1 11/1983

(Continued)

*Primary Examiner*—Jose V. Chen

(57) ABSTRACT

A pallet assembly includes an upper deck and a lower deck spaced by a plurality of columns. The weight of the pallet is reduced without significant reduction in strength by providing only a single cross beam in each of the upper and lower reinforcement members and orienting them perpendicular to one another. The reinforcement members are minimized for weight reduction and for improved performance in heat tests. The peripheral rail of the upper reinforcement member is reduced such that it rests on only an inwardly open recess on an inner corner of each of the corner columns. This reduces the size and weight of the upper reinforcement member, while still providing support to the upper deck. Additionally, the peripheral rails of both the upper and lower decks are reduced in length such that either ledge does not directly support them while the pallet is stored on a rack. As a result, in the case of sufficient heat source on the pallets, the pallets will eventually collapse without interference from the reinforcement members and at least partially smother the heat source.

17 Claims, 11 Drawing Sheets

U.S. PATENT DOCUMENTS

| | | | | |
|---|---|---|---|---|
| 5,890,437 | A | 4/1999 | Hill | |
| 5,894,803 | A * | 4/1999 | Kuga | 108/51.11 |
| 5,937,767 | A | 8/1999 | Togawa et al. | |
| 5,950,546 | A | 9/1999 | Brown et al. | |
| 6,006,677 | A | 12/1999 | Apps et al. | |
| 6,053,466 | A | 4/2000 | Jordan et al. | |
| 6,095,061 | A | 8/2000 | Perazzo | |
| 6,125,770 | A | 10/2000 | Brandenburg | |
| 6,138,582 | A | 10/2000 | Fujii et al. | |
| 6,173,657 | B1 | 1/2001 | Espejo | |
| 6,199,488 | B1 | 3/2001 | Favaron et al. | |
| 6,237,509 | B1 | 5/2001 | Ishido et al. | |
| 6,250,234 | B1 | 6/2001 | Apps | |
| 6,263,807 | B1 | 7/2001 | Fox et al. | |
| 6,283,044 | B1 | 9/2001 | Apps | |
| 6,289,823 | B1 | 9/2001 | Koefelda et al. | |
| 6,305,301 | B1 | 10/2001 | Piper, Jr. et al. | |
| 6,357,366 | B1 * | 3/2002 | Frankenberg | 108/57.25 |
| 6,389,990 | B1 | 5/2002 | Apps | |
| 6,446,563 | B1 | 9/2002 | Ohanesian | |
| 6,584,914 | B1 | 7/2003 | Koefelda | |
| 6,622,642 | B1 | 9/2003 | Ohanesian | |
| 6,705,237 | B1 | 3/2004 | Moore, Jr. et al. | |
| 6,748,876 | B1 * | 6/2004 | Preisler et al. | 108/57.25 |
| 6,807,910 | B1 * | 10/2004 | Apps | 108/57.25 |
| 2001/0029874 | A1 | 10/2001 | Muirhead | |
| 2001/0031807 | A1 | 10/2001 | Adedeji et al. | |
| 2003/0075082 | A1 | 4/2003 | Apps | |
| 2003/0079658 | A1 | 5/2003 | Torrey et al. | |
| 2003/0079660 | A1 | 5/2003 | Torrey et al. | |

FOREIGN PATENT DOCUMENTS

| | | | |
|---|---|---|---|
| EP | 0068586 | A1 | 6/1982 |
| EP | 0 997 383 | A1 | 5/2000 |
| WO | WO 90/01448 | A2 | 2/1990 |
| WO | WO 99/35041 | A1 | 12/1998 |
| WO | WO 00/01588 | A1 | 6/1999 |
| WO | WO 02/016214 | A2 | 8/2001 |
| WO | WO 01/64526 | A2 | 9/2001 |
| WO | WO 03/035495 | A1 | 5/2003 |
| WO | WO 03/035496 | A1 | 5/2003 |

* cited by examiner

PALLET ASSEMBLY

BACKGROUND OF THE INVENTION

The present invention relates to a pallet assembly and more particularly to a plastic pallet with reinforcement members.

Pallets are often used to store and transport goods. Pallets maintain the goods at a distance above the floor such that they can readily be lifted and moved by a forklift. Plastic pallets are lighter and more durable than wooden pallets. Elongated metal or composite reinforcement members have been used in some plastic pallets in order to increase the stiffness and load-bearing capacity of the pallet.

Some pallets comprise upper and lower decks separated by a plurality of columns that maintain the space between the upper and lower decks. The pallets may have reinforcement bars sandwiched between two layers in the upper deck or the lower deck. Traditionally, the reinforcement bars were straight bars inserted into the upper deck. One pallet previously developed by the assignee of the present invention includes reinforcement members with a frame or peripheral rail extending continuously and completely about the outer periphery of the deck and a pair of perpendicular cross beams connected to the peripheral rail. The cross beams are centered on the columns for support and the peripheral rail is also either centered on the columns or positioned outwardly of center of the columns.

It is desirable to minimize the number of components of the pallet and minimize the weight of the pallet while retaining the rigidity of the pallet. Additionally, some plastic pallets are evaluated for their performance under Underwriters Laboratories, Inc. (UL) Standard 2335, which, in part, evaluates the heat release performance of plastic pallets while stored on racks having inwardly extending ledges upon which the pallets are supported. Ways have been sought to manufacture the pallets of fire-retardant materials.

SUMMARY OF THE INVENTION

The present invention provides a reinforced pallet assembly with fewer components, increased strength, reduced weight and improved performance under UL standard 2335.

The pallet assembly of the present invention includes an upper deck and a lower deck spaced by a plurality of columns. In a first feature described below, the weight of the pallet is reduced without significant reduction in strength by providing only a single cross beam in each of the upper and lower reinforcement members and orienting them perpendicular to one another.

In another feature according to the present invention, the size of the reinforcement members are minimized for weight reduction and for improved performance under UL standard 2335. The reinforcement members each include a frame or peripheral rail. The peripheral rail of the upper reinforcement member is minimized such that it rests on only an inwardly open recess on an inner corner of each of the corner columns. This reduces the size and weight of the upper reinforcement member, while still providing support to the upper deck. Additionally, the peripheral rail of lower deck is reduced in length such that neither ledge directly supports it while the pallet is stored on a rack. Similarly, the length of the peripheral rail of the upper deck is also less than the distance between the ledges. The reinforcement members are spaced from the pallet outer edges of the pallet by a distance greater than the width of the ledges. In one embodiment, the outer dimensions of the reinforcement members are less than the distance between an inner edge of one ledge to the inner edge of the opposite ledge. As a result, in the Commodity Classification test portion of UL standard 2335, the pallets will eventually collapse without interference from the reinforcement members and at least partially smother the heat source.

BRIEF DESCRIPTION OF THE DRAWINGS

Other advantages of the present invention will be readily appreciated as the same becomes better understood by reference to the following detailed description when considered in connection with the accompanying scale drawings wherein.

DETAILED DESCRIPTION OF A PREFERRED EMBODIMENT

Figure 1:
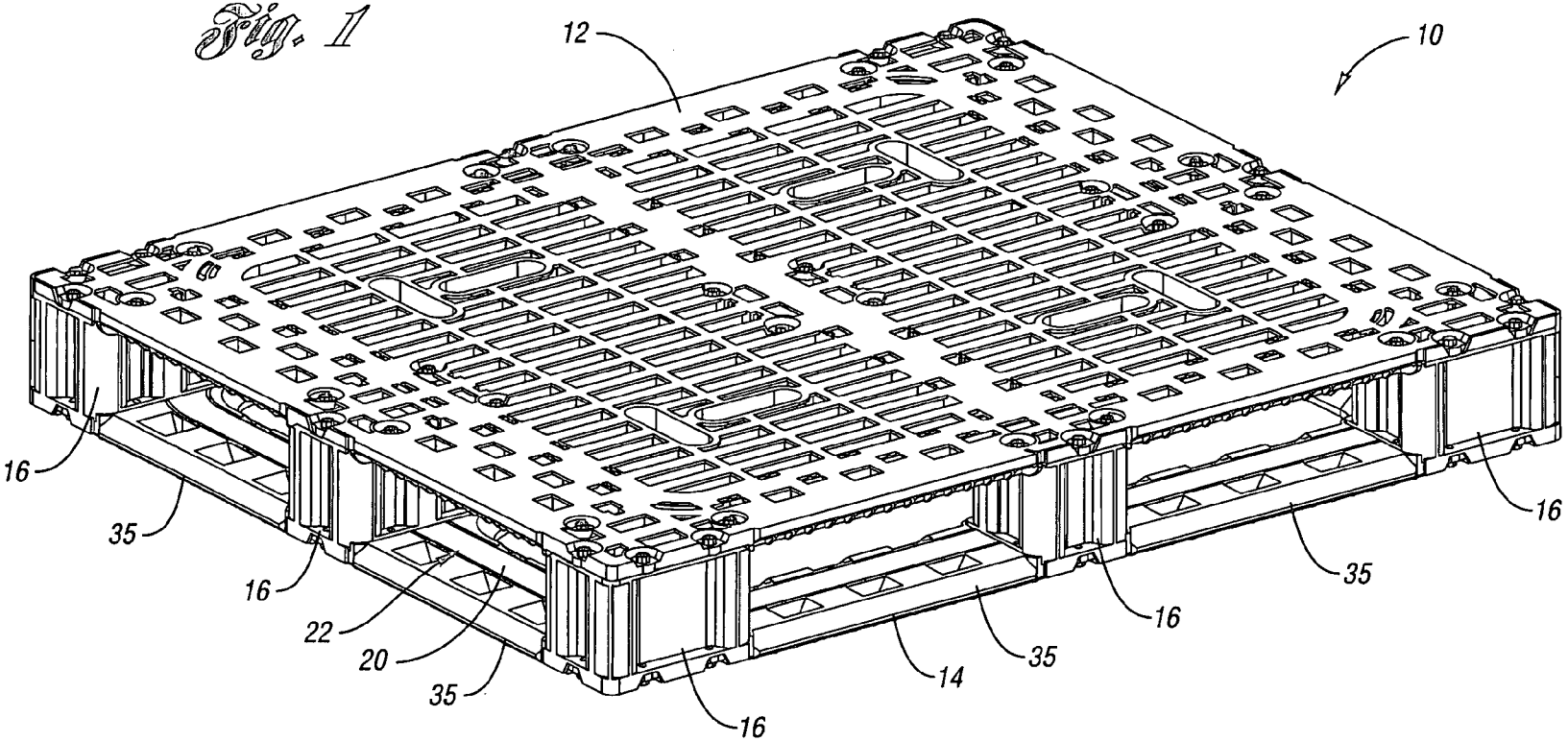
FIG. 1 is a perspective view of the pallet assembly according to the present invention.

A pallet assembly 10 according to the present invention is illustrated in FIG. 1. The pallet assembly 10 generally includes a molded plastic upper deck 12 and a molded plastic lower deck 14 spaced apart by a plurality of molded plastic columns 16. A lower reinforcement member 20 is received within a channel 22 formed in the upper surface of the lower deck 14. A tapered molded rail 35 extends around the entire periphery of the lower deck 14 to ease fork entry into openings defined between the columns 16.

Figure 2:
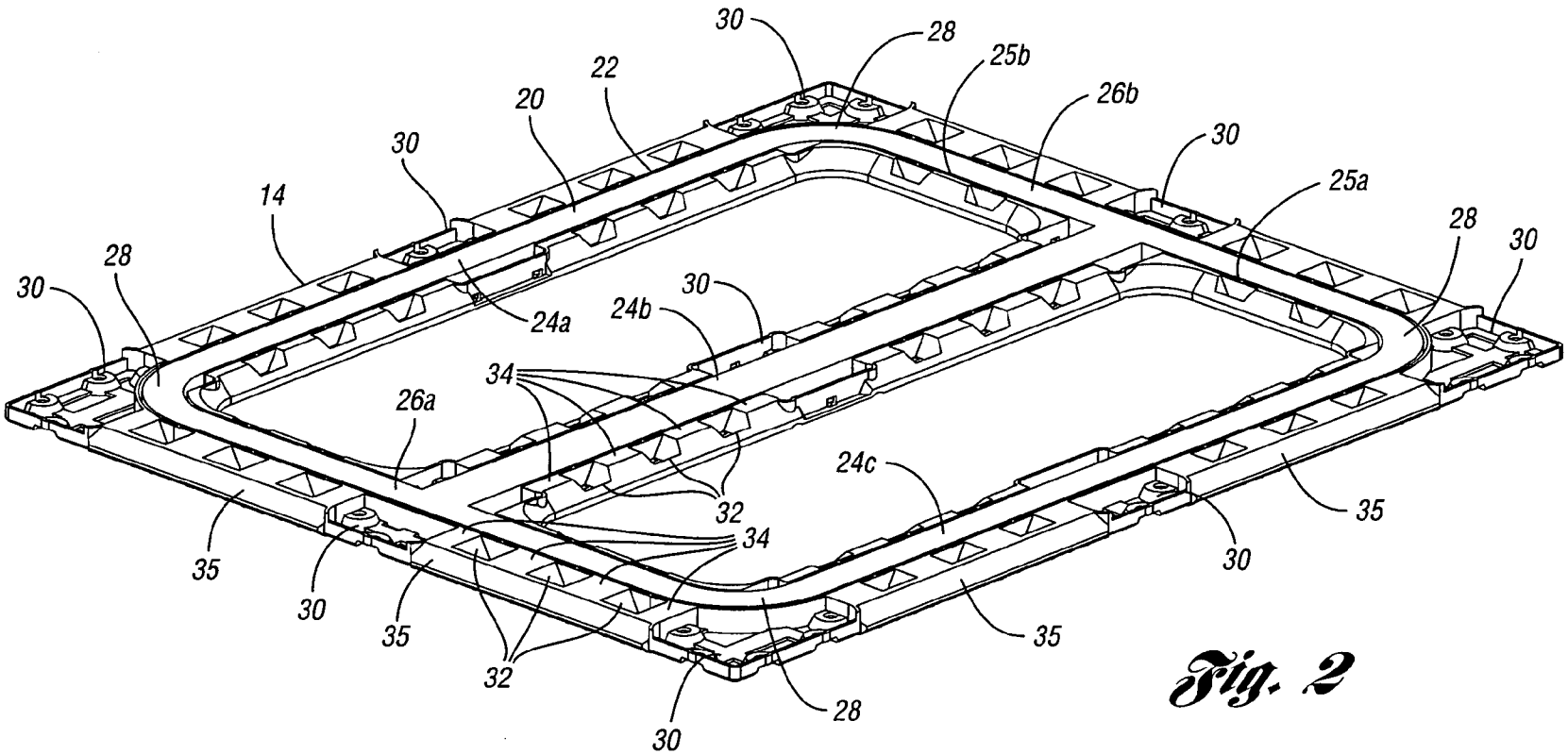
FIG. 2 is a perspective view of the lower deck and lower reinforcement member of the pallet of FIG. 1.

FIG. 2 illustrates the lower deck 14 and lower reinforcement member 20. As can be seen in FIG. 2, the lower reinforcement member 20 comprises two laterally extending rail sections 26*a* and 26*b* at opposite ends of the lower deck 14 and three longitudinally extending rail sections 24*a*, 24*b* and 24*c* connecting the laterally extending rail sections 26*a* and 26*b*. The two laterally extending rail sections 26*a*, 26*b* together with two of the longitudinally extending rail sections 24*a* and 24*c* are connected at rounded corners 28 to form a frame or peripheral rail, generally about the periphery of the bottom deck 14. The center longitudinally extending rail section 24*b* connects the laterally extending rail sections 26*a* and 26*b*. The central longitudinally extending rail section 24*b* generally bisects the opening defined by the peripheral rail of the lower reinforcement member 20 to create a first uninterrupted space 25*a* defined among the rail sections 24*a*, 24*b*, 26*a*, 26*b* and a second uninterrupted space 25*b* between rail sections 24*b*, 24*c*, 26*a*, 26*b*. In the embodiment shown, there is no cross bar perpendicular to the center longitudinally extending rail section 24*b*. All of the lower reinforcement member 20 is received within the channel 22 formed in the lower deck 14. The channels 22 pass through column mounts 30 formed in the lower deck 14. The column mounts 30 are molded recesses for receiving columns 16 (shown in FIG. 1). As can be seen in FIG. 2, the channels 22 and the lower reinforcement member 20 pass through each of the column mounts 30. The reinforcement member 20 may be formed of any material having the desired properties, including metal (such as steel) or composite material, and may have a tubular or I-beam cross-section or any known shape for reinforcement members.

The lower deck 14 further includes a plurality of molded pockets 32 alternating with molded protrusions 34 on either side of channels 22. These provide reinforcement to the lower deck 14 and improve cleanliness because they do not create small cavities that entrap dirt as do typical, closely-spaced ribs extending in the same direction from a planar member that form many cavities opening in the same direction. Each molded pocket 32 and molded protrusion 34 forms a corresponding molded protrusion 34 and molded pocket 32, respectively, on the underside of the lower deck 14. A tapered molded rail 35 extends around the entire periphery of the lower deck 14 outside of the molded protrusions 34 and pockets 32. The tapered molded rail 35 provides ease of fork entry and minimizes pallet damage by guiding the fork tines into the openings during fork entry.

Figure 3:
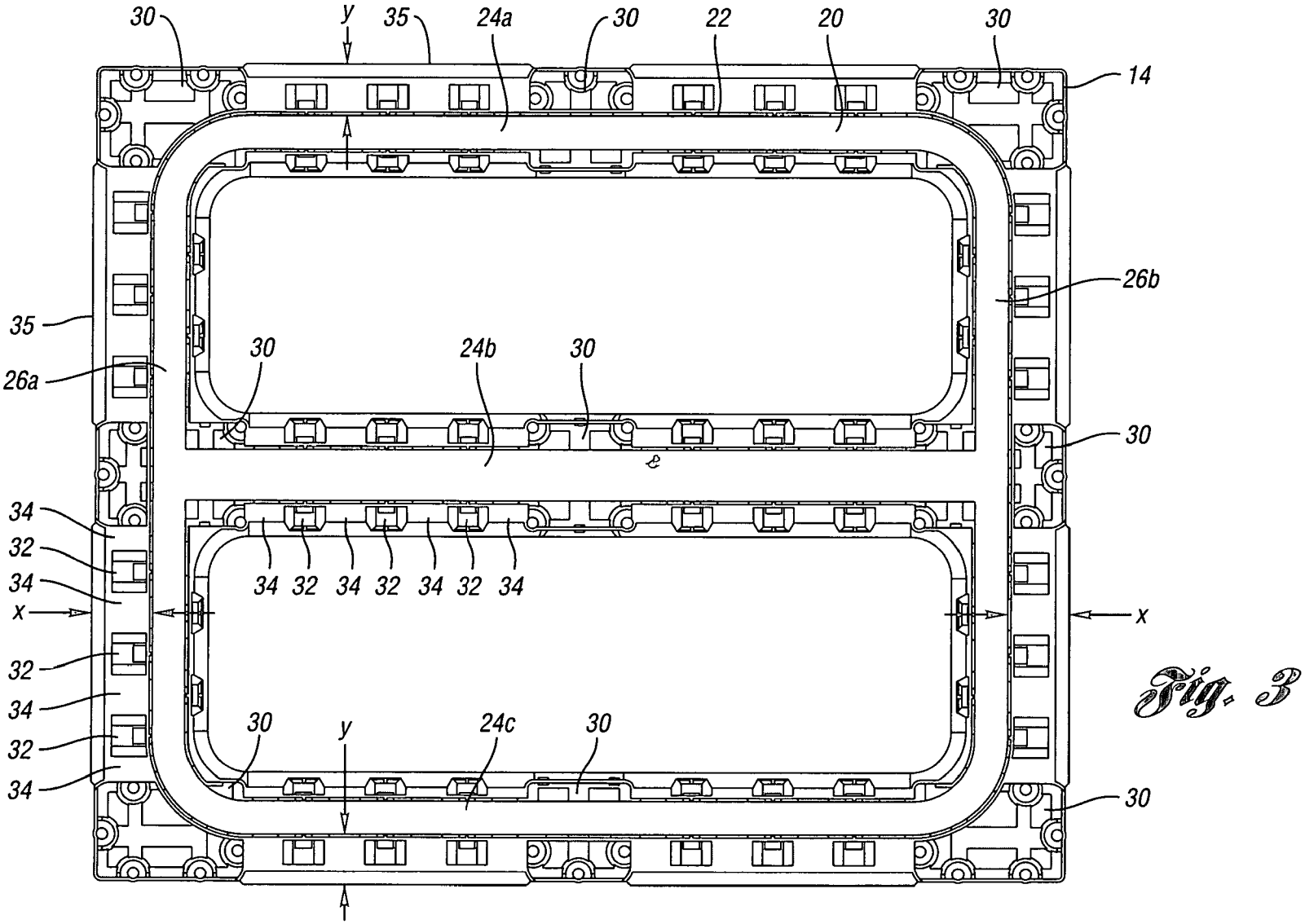
FIG. 3 is a plan view of the lower deck and lower reinforcement member of FIG. 2.

As can be seen in FIG. 3, the laterally extending rail sections 26*a* and 26*b* are spaced from the outer edges of the lower deck 14 by a distance x. The longitudinally extending rail sections 24*a* and 24*c* are spaced from the outer edges of the lower deck 14 by a distance y. As will be explained below, the distances x and y may vary based upon the particular pallet size, or pallet standard, or particular application. In the embodiment shown, for a 40" by 48" pallet, x is preferably greater than two inches and more preferably approximately three inches. In the particular embodiment shown, x is three inches. The y dimension could differ from the x dimension, but in the preferred embodiment is similarly preferably greater than two inches and more preferably approximately two and a half inches. In the particular embodiment shown, y is two and a half inches.

Figure 3A:
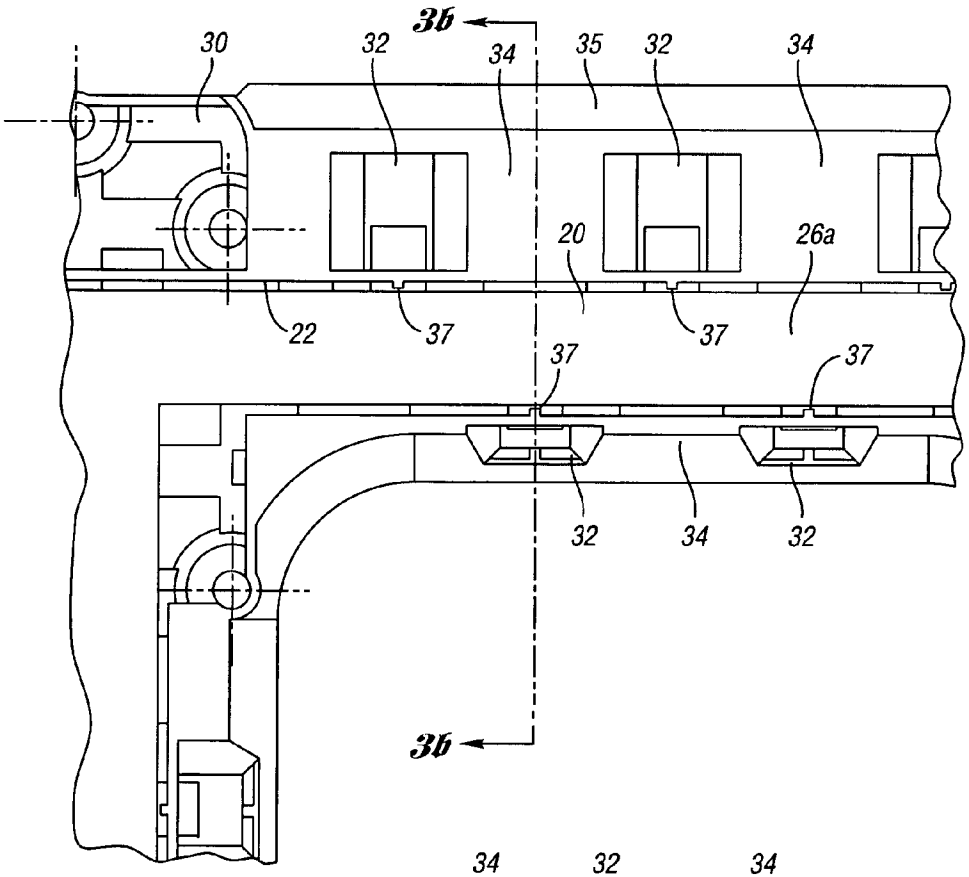
FIG. 3A is an enlarged view of a portion of the lower deck and lower reinforcement member of FIG. 3.
Figure 3B:
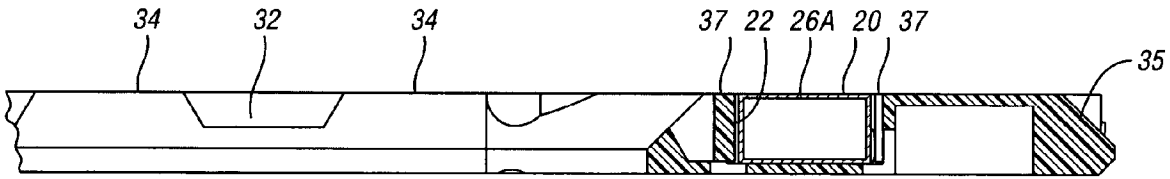
FIG. 3B is a section view of the lower deck and reinforcement member taken along line 3B—3B of FIG. 3A.

FIG. 3A is an enlarged view of a portion of the lower deck 14 and lower reinforcement member 20 in which it can be seen that the rail section 26*a* of the reinforcement member 20 is positioned in the channel 22 between flex ribs 37 extending from either side of channel 22 toward the rail section 26*a*. The flex ribs 37 can also be seen in FIG. 3B. The flex ribs 37 serve two purposes. First, during manufacture the extent to which the ribs extend inwardly can be adjusted by modifying the mold more easily than modifying the mold in order to move an entire wall of the channel 22. This adjustment feature can be used to accommodate manufacturing tolerances between the reinforcement member 20 and the lower deck 14. Also, when in use, the flex ribs 37 provide some flexibility such that the different rates of thermal shrinkage and expansion between the reinforcement members can be accommodated by flexure of the flex ribs 37. Additionally, the flex ribs 37 permit the plastic deck 14 to flex in relation to the rigid reinforcement member 20 during impact and/or loading. In general, the reinforcement member 20 is free floating within the channel 22 in the x and y directions and sandwiched in the z direction.

Figure 4:
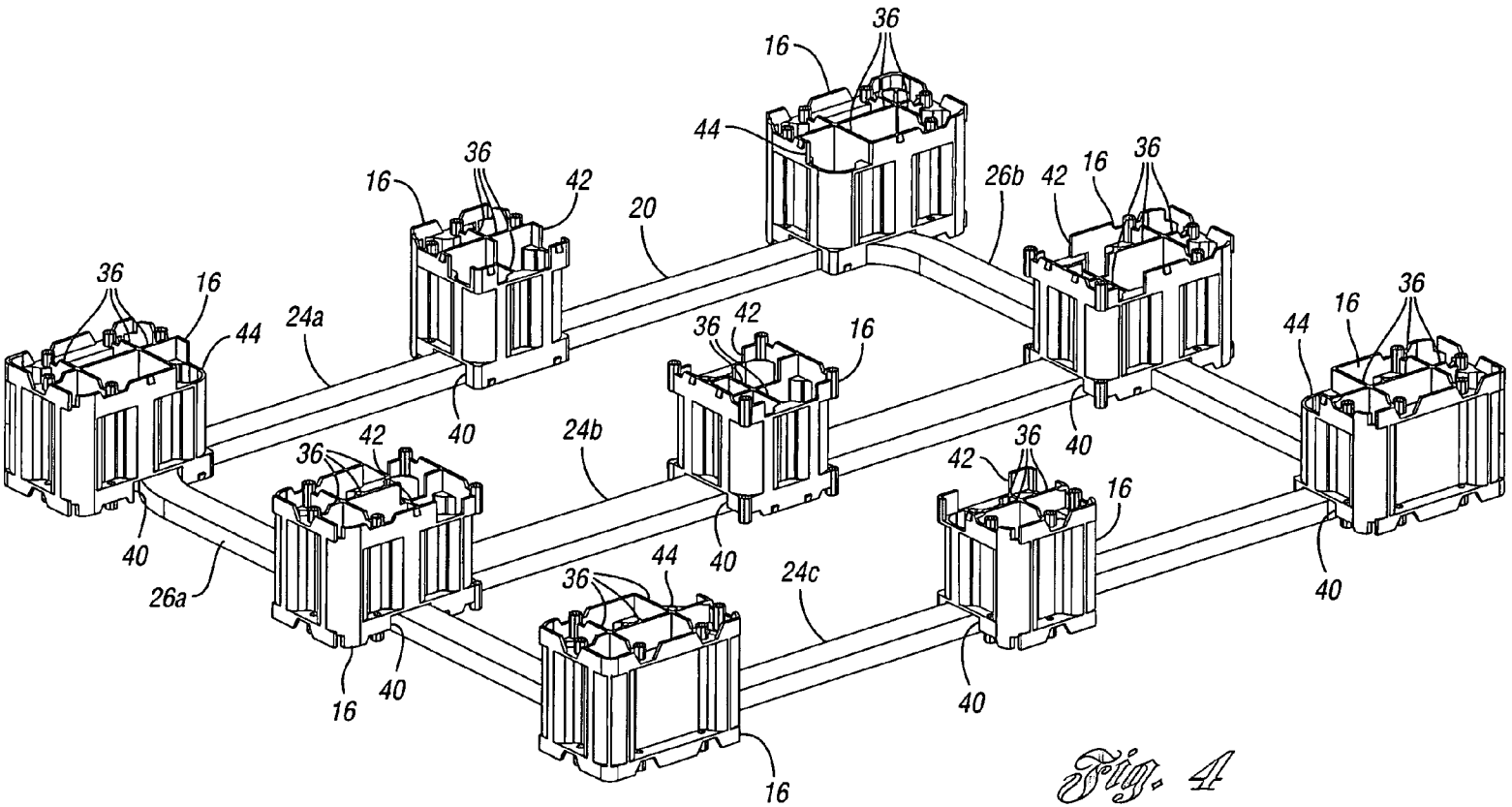
FIG. 4 is a perspective view of the lower reinforcement member and columns of FIG. 1.

FIG. 4 illustrates the lower reinforcement member 20 and columns 16. Each of the columns 16 includes cross-ribs 36 extending vertically through the columns. Formed in the cross-ribs 36 in each column is a lower channel 40 passing through the lower end of the column 16 and into which the lower reinforcement member 20 is received such that lower edges of the cross-ribs 36 abut the lower reinforcement member 20. Each of the columns 16, other than the corner columns 16, also includes an upper channel 42 through an upper end of the cross-ribs 36 of the column 16. At the upper end of each of the corner columns 16 is an inwardly open corner recess 44 for receiving a reinforcement member.

Figure 5:
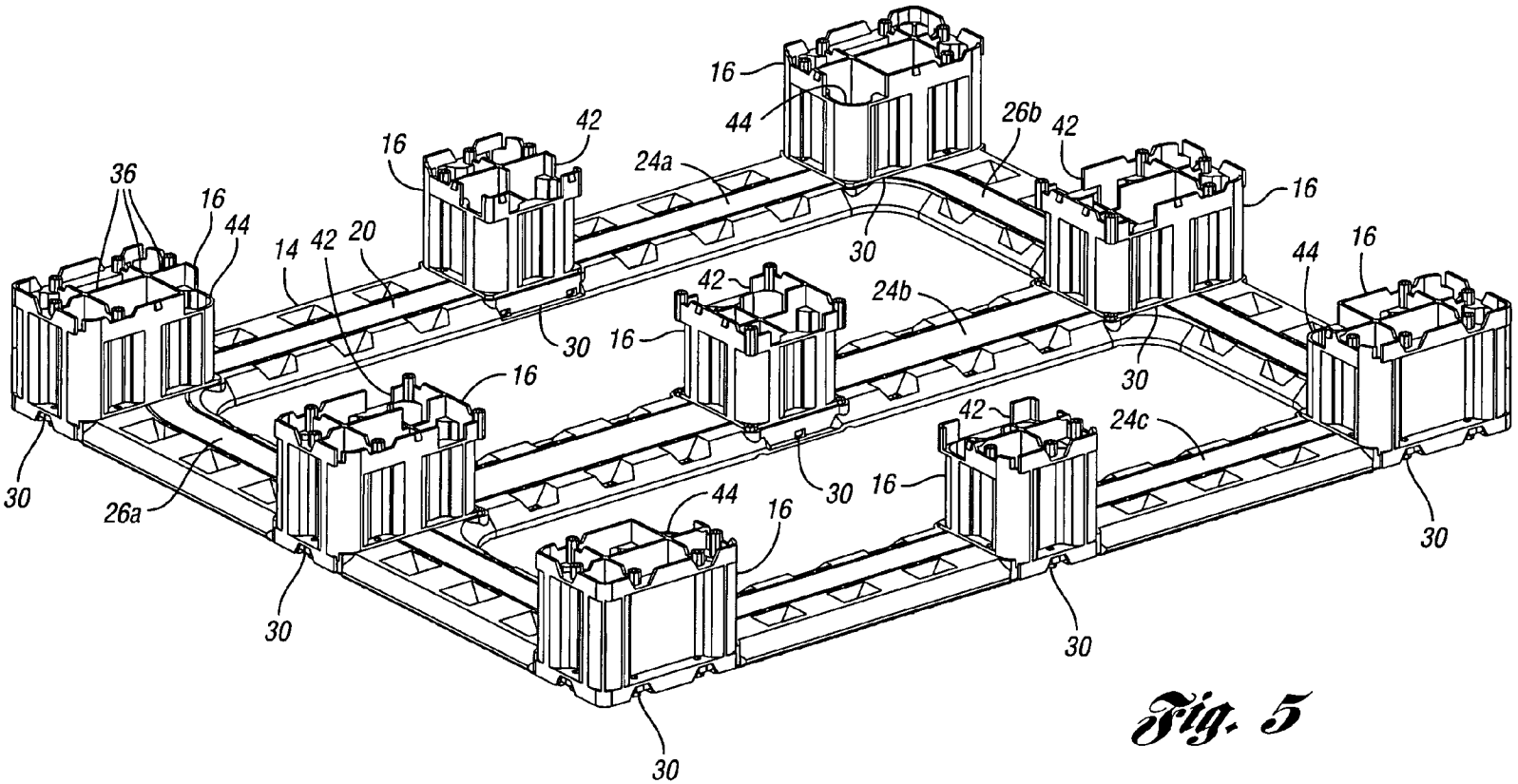
FIG. 5 is a perspective view of the columns, lower reinforcement member and lower deck of FIG. 1.

FIG. 5 illustrates the lower reinforcement member 20 and columns 16 with the addition of the lower deck 14. As can be seen in FIG. 5, the columns 16 are secured to the lower deck 14 over the lower reinforcement member 20 and the column mounts 30 via snap-fit connections and/or heat staking, adhesive, hot-plate welding, or other known methods.

Figure 6:
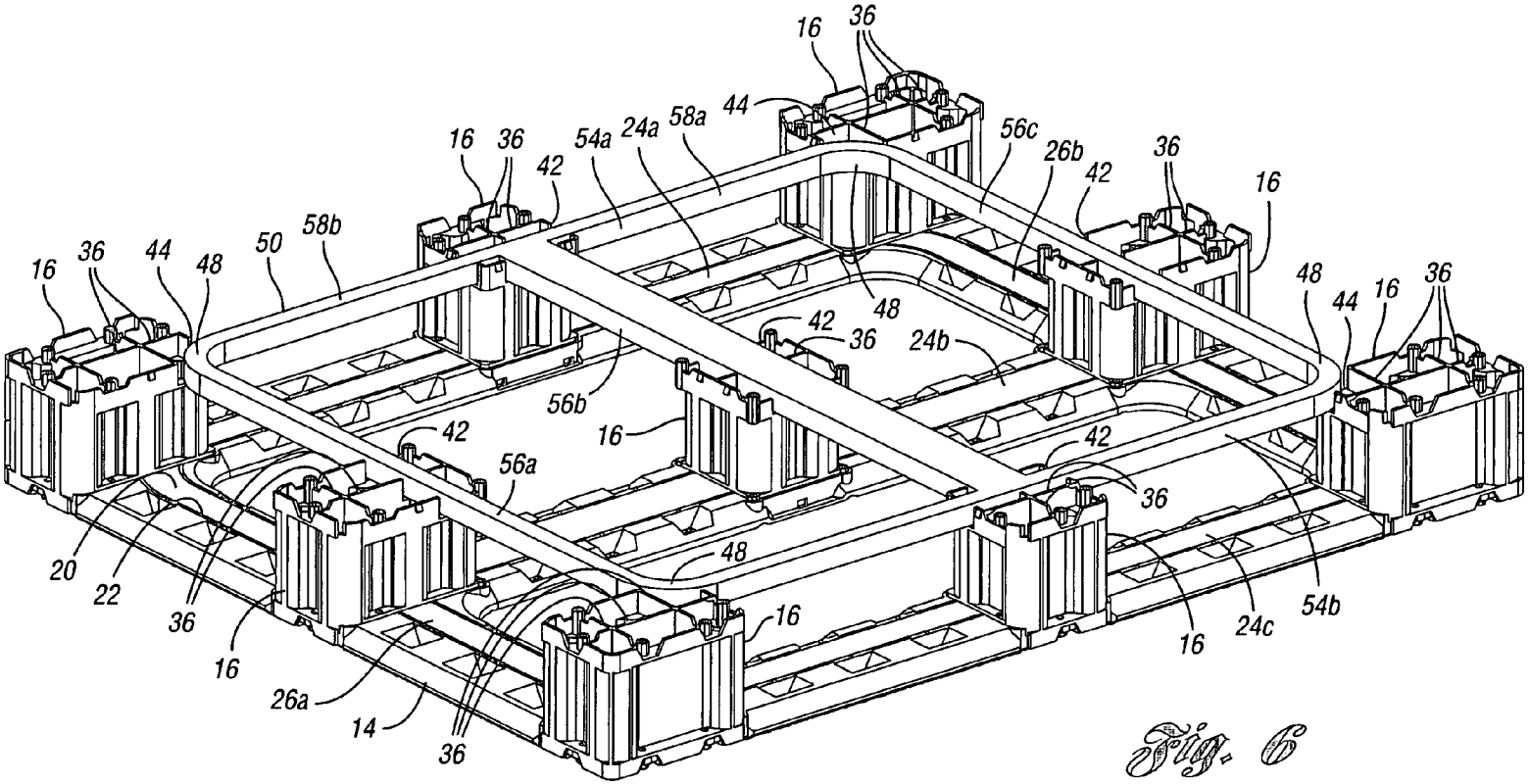
FIG. 6 is a perspective view of the upper reinforcement member, columns, lower reinforcement member and lower deck of FIG. 1.

FIG. 6 illustrates the sub-assembly of FIG. 5 with the addition of the upper reinforcement member 50. The upper reinforcement member 50 comprises longitudinally extending rail sections 54*a* and 54*b* and laterally extending rail sections 56*a*, 56*b* and 56*c*. The longitudinally extending rail sections 54*a* and 54*b* are joined with the outer laterally extending rail sections 56*a* and 56*c* at rounded corners 48 to form a peripheral rail with a single cross-bar 56*b* extending from longitudinally extending rail 54*a* to longitudinally extending rail section 54*b*. The center laterally extending rail section 56*b* generally bisects the opening defined by the peripheral rail sections and defines an uninterrupted space 58*a* among rail sections 56*b*, 56*c*, 54*a*, 54*b* and an uninterrupted space 58*b* among rail sections 56*b*, 56*a*, 54*a*, 54*b*. Each of the rail sections is received within a channel 42 in the cross ribs 36 in the upper end of the columns 16 such that the upper edges of the cross-ribs 36 abut the upper reinforcement member 50. Each of the rounded corners 48 is received within the inwardly open corner recess 44 formed on each of the inner corners of each of the corner columns 16.

Figure 7:
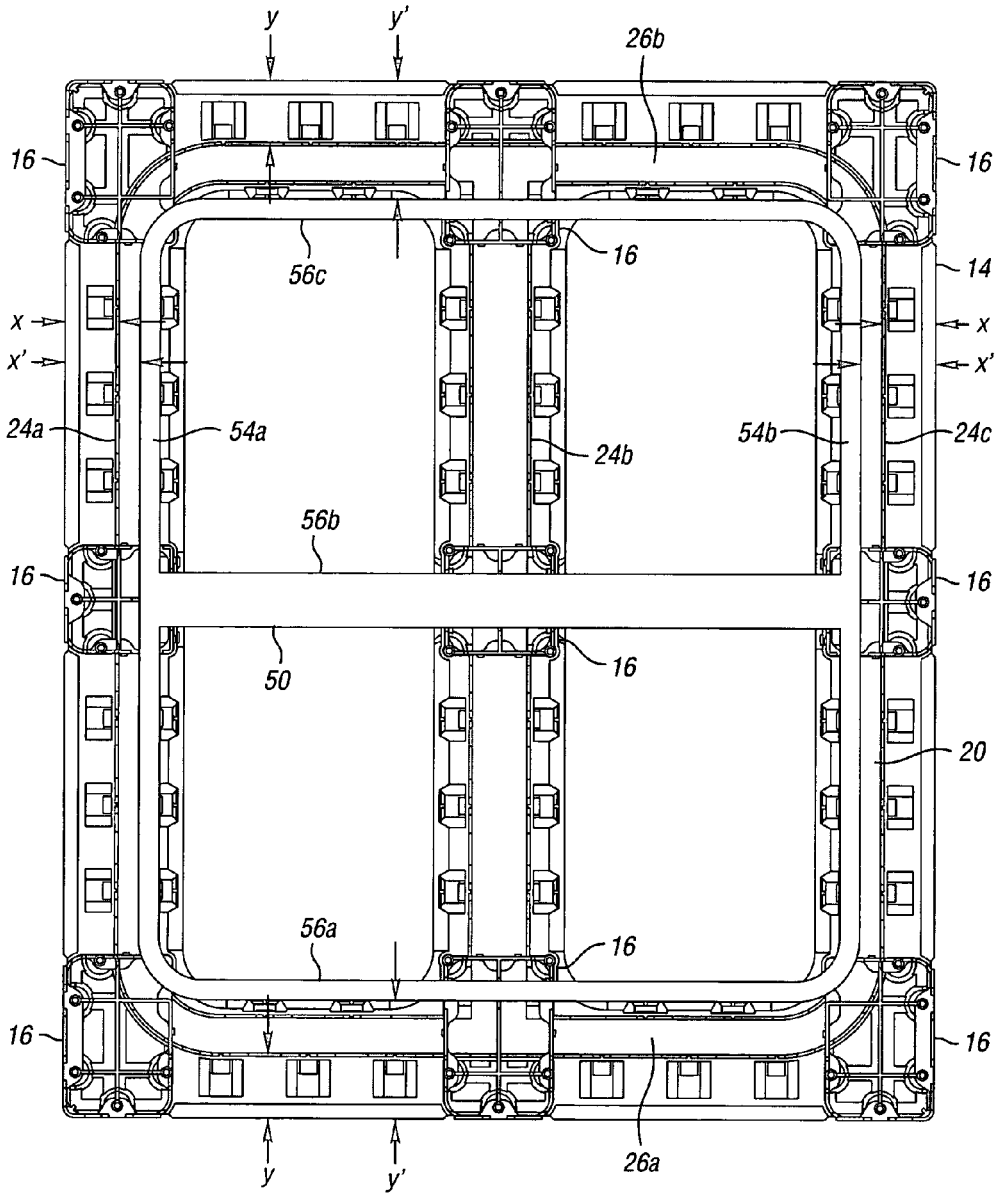
FIG. 7 is a plan view of the sub-assembly of FIG. 6.

FIG. 7 is a top view of the sub-assembly of FIG. 6. As can be seen in FIG. 7, the upper reinforcement member 50 is positioned inwardly of the lower reinforcement member 20. In particular, the laterally extending rail sections 56*a* and 56*c* are positioned a distance y' from the outer edge of the decks and are disposed completely inwardly of the laterally extending rail sections 26*a*, 26*b* of the lower member 20. The distance y' is preferably greater than two inches, more preferably greater than three inches and most preferable five and a half inches. The longitudinally extending rail sections 54*a*, 54*b* of the upper reinforcement member 50 are positioned at a distance x' from the outer edge of the decks and at least partially inwardly of the longitudinally extending rail sections 24*a* and 24*c* of the lower member 20. The distance x' is preferably greater than two inches and more preferably greater than three inches. In the embodiment shown, x' is three and a half inches.

Figure 8:
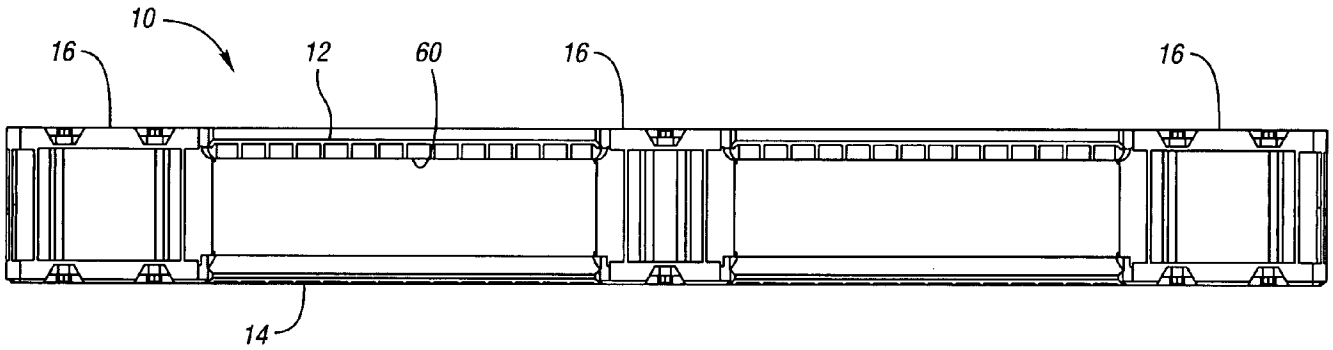
FIG. 8 is a side view of the pallet assembly of FIG. 1.
Figure 9:
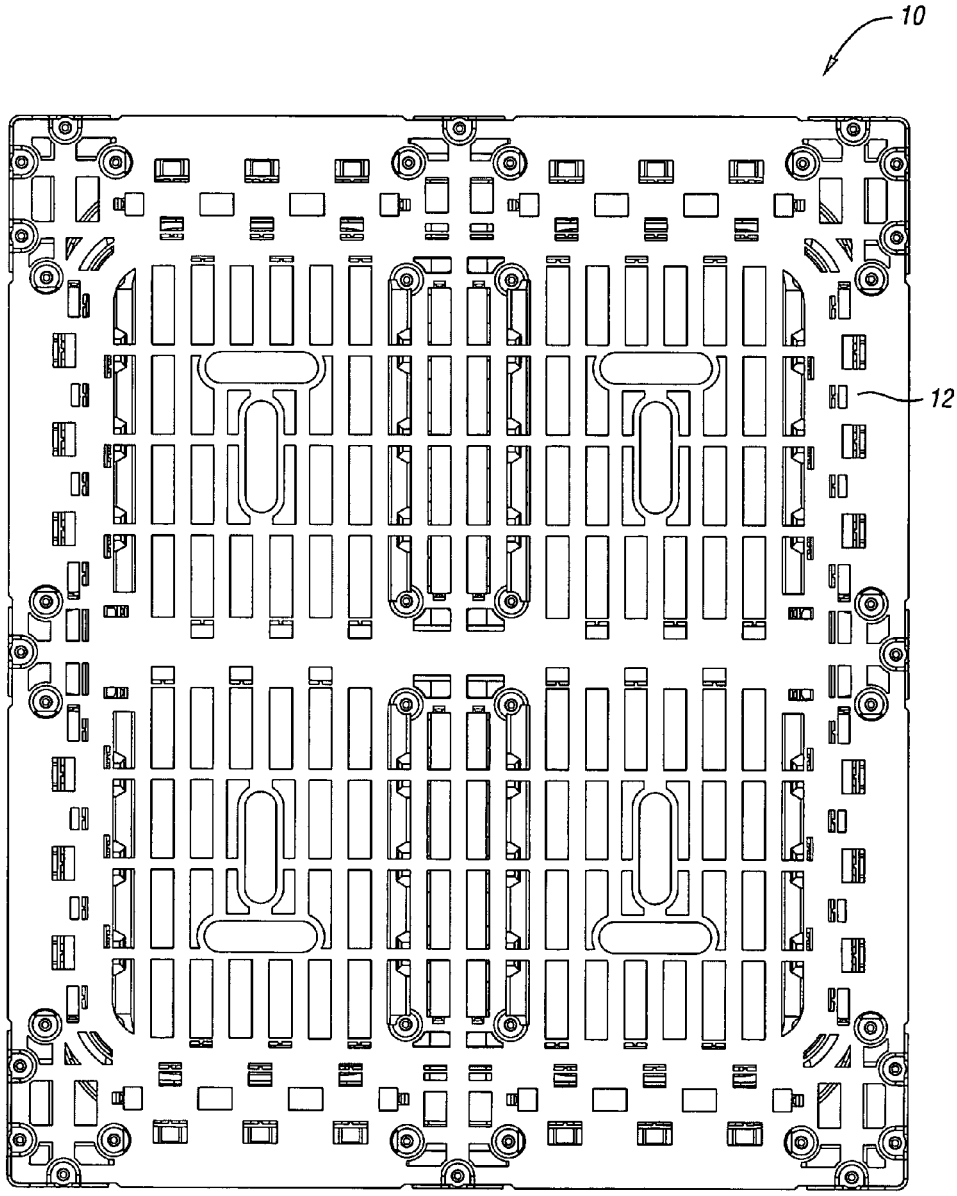
FIG. 9 is a top view of the pallet assembly of FIG. 1.

FIG. 8 is a side view of the completely assembled pallet assembly 10 of FIG. 1. As can be seen in FIG. 8, the upper deck 12 includes a plurality of cross-rib members 60 extending downwardly to provide increased support. FIG. 9 is a top view of the pallet assembly 10 according to the present invention.

Figure 10:
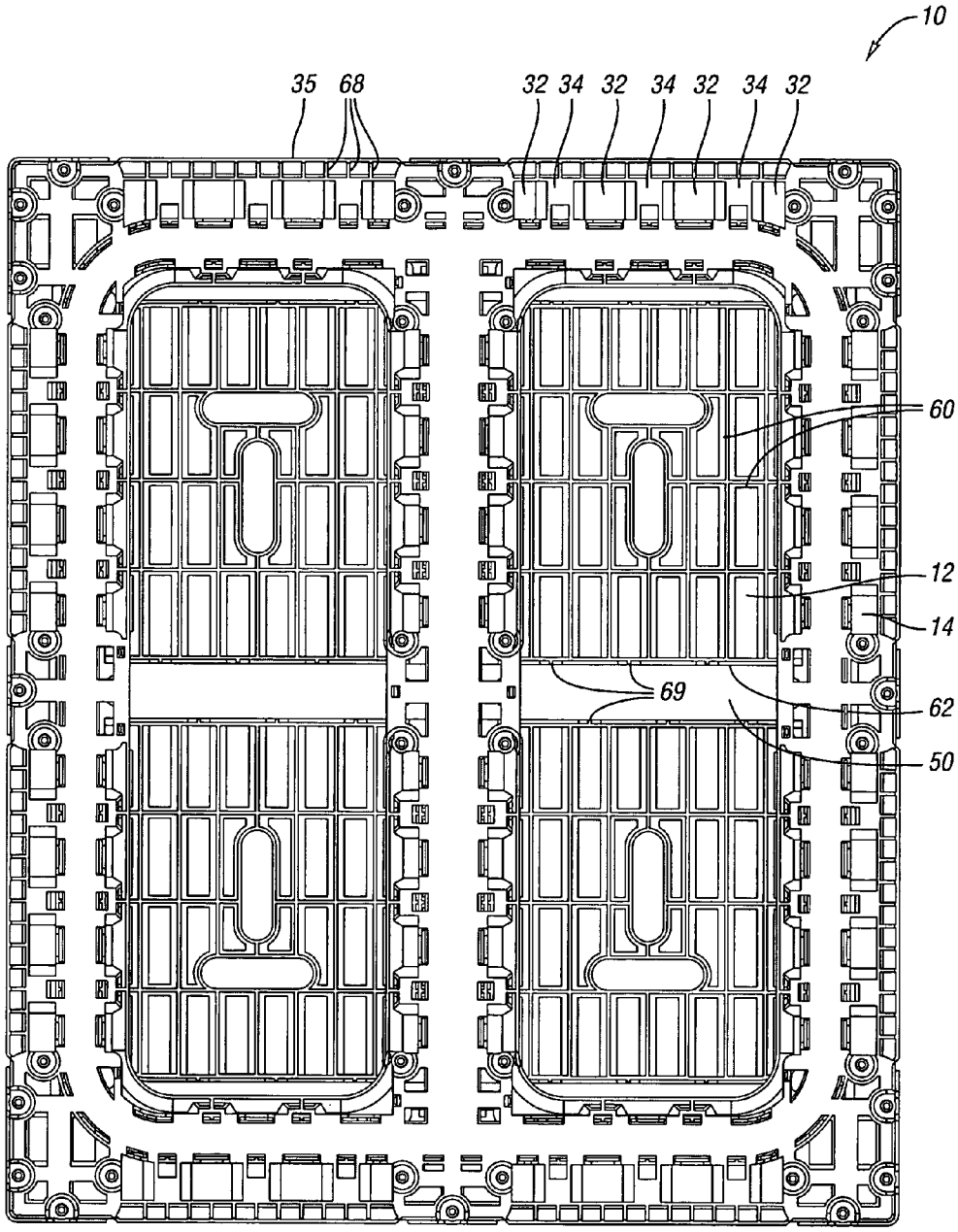
FIG. 10 is a bottom view of the pallet assembly of FIG. 1.

FIG. 10 is a bottom view of the pallet assembly 10, showing the cross-rib members 60 on the underside of the upper deck 12 which also define a channel 62 into which the reinforcement member 50 is received. FIG. 10 also shows the molded pockets 32 and protrusions 34 formed on the underside of the lower deck 14 and the molded rail 35 around the periphery of the lower deck 14. Ribs 68 extend downwardly inside the molded rail 35. The channel 62 of the upper deck 12 also includes flex ribs 69 similar to those described above with respect to the lower deck 14.

Figure 11:
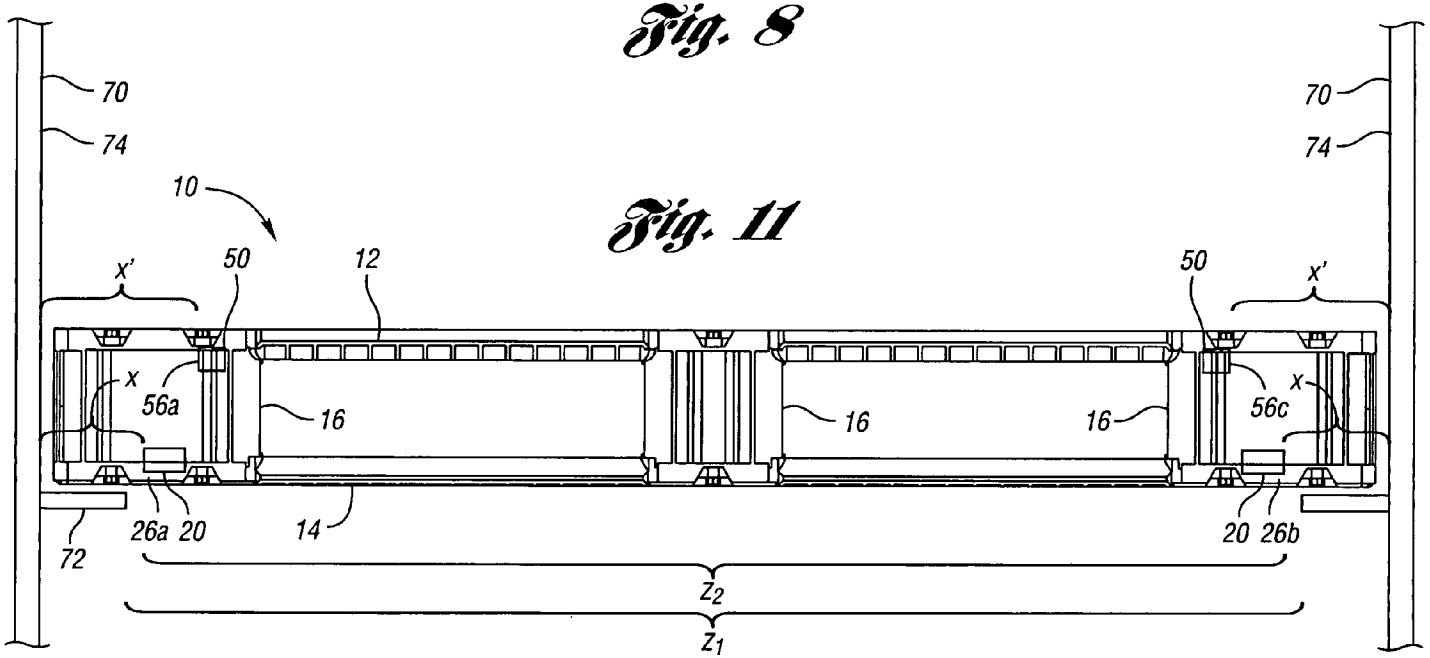
FIG. 11 is a side view of the pallet assembly of FIG. 1 positioned on a rack.

FIG. 11 illustrates the pallet assembly 10 mounted in a rack 70 having ledges 72 extending perpendicularly from vertical supports 74. For one known rack, the standard width for the ledges 72 is two inches. Thus, by ensuring that the distance, x and x', from the outer edges of the pallet assembly 10 to the reinforcement members exceed the width of the ledges 72, in the event that a heat source or other source causes the pallet assembly 10 to collapse. In other words, the distance $z_1$ between an inner edge of one ledge 72 to an inner edge of the opposite ledge 72 is preferably greater than the outer dimension $z_2$ of the reinforcement members 20 and 50. The collapsing pallet assembly may in some circumstances assist in at least partially smothering the heat source that may be located below.

The upper and lower decks 12, 14 of the pallet assembly 10 of the present invention are each preferably formed in one piece of polypropylene via an injection molding process, but of course can be formed of any type of plastic applicable for the desired use. The columns 16 are each preferably formed in one piece of polyethylene via an injection molding process, but of course can be formed of any type of plastic applicable for the desired use. The materials may be chosen and distributed in accordance with the teachings of co-pending U.S. patent application Ser. No. 10/040,098, entitled "Pallet Assembly," filed Oct. 19, 2001, commonly assigned and hereby incorporated by reference in its entirety. While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention. There are many different configurations for pallet assemblies and many variations in design, many of which would benefit from the present invention.

What is claimed is:

1. A pallet storage rack and a reinforced pallet assembly comprising:

the pallet storage rack including a ledge; and the reinforced pallet assembly stored on the rack, the reinforced pallet assembly including:

a first deck;

a second deck;

a plurality of columns between the first deck and the second deck; and a reinforcement member between the second deck and at least one of the plurality of columns, the reinforcement member comprising at least one peripheral rail and at least one cross-bar connected to the peripheral rail, wherein the at least one peripheral rail comprises at least two parallel peripheral rail sections connected by and perpendicular to the cross-bar, each of the peripheral rail sections positioned between one of the plurality of columns and the second deck, at least one of the peripheral rail sections positioned more than 2" from a closest parallel outer edge of the second deck, the ledge extending inwardly from the outer edge of the second deck and positioned under the second deck, but not positioned directly under the reinforcement member.

2. The pallet storage rack and the reinforced pallet assembly of claim 1 wherein the reinforcement member is a second reinforcement member and the pallet assembly further includes a first reinforcement member between the at least one of the plurality of columns and the first deck, the first reinforcement member including a peripheral rail positioned inwardly of the peripheral rail of the second reinforcement member.

3. The pallet storage rack and the reinforced pallet assembly of claim 1 wherein the reinforcement member is a second reinforcement member and the pallet assembly further including a first reinforcement member between the plurality of columns and the first deck, the first reinforcement member including a peripheral rail section generally parallel to the peripheral rail sections of the second reinforcement member and positioned inwardly more than 2" from a closest parallel outer edge of the first deck.

4. The pallet storage rack and the reinforced pallet assembly of claim 1, wherein the ledge is one of a pair of ledges on the rack positioned under the second deck, the pair of ledges extending inwardly from the outer edge and an opposite outer edge of the second deck, outer edges of the reinforcement member adjacent the pair of ledges separated by a distance less than a distance between inner edges of the pair of ledges.

5. A rack and reinforced pallet assembly comprising:

the reinforced pallet assembly including a first deck, a second deck and a plurality of columns between the first deck and the second deck, the reinforced pallet assembly including a reinforcement member between the second deck and at least one of the plurality of columns, the reinforcement member arranged such that the reinforcement member would not prevent the pallet from falling from the rack in the event that at least one of the first and second decks collapses, the reinforced pallet assembly positioned on the rack;

the rack having a pair of ledges positioned under the second deck, the ledges extending inwardly from opposite outer edges of the second deck, a length of the reinforcement member extending across the second deck to positions adjacent each ledge, wherein the length of the reinforcement member is less than a distance between inner edges of the pair of ledges.

6. The rack and reinforced pallet assembly of claim 5 wherein the reinforcement member extends substantially across the second deck but is shorter than a distance between two opposed ledges of the rack.

7. The rack and reinforced pallet assembly of claim 5 wherein the second deck includes two opposite edges in a first direction and wherein the reinforcement member extends across the second deck in the first direction and is positioned more than two inches from at least one of the two opposite edges of the second deck.

8. The rack and reinforced pallet assembly of claim 7 wherein the reinforcement member is positioned more than two inches from each of the two opposite edges of the second deck.

9. The rack and reinforced pallet assembly of claim 7 wherein the reinforcement member is positioned approximately three inches from the at least one edge.

10. The rack and reinforced pallet assembly of claim 9 wherein the reinforcement member is positioned approximately three inches from each of the two opposite edges of the second deck.

11. The rack and reinforced pallet assembly of claim 5 wherein the reinforcement member includes a peripheral rail extending continuously along and spaced inwardly from a periphery of the second deck.

12. A pallet assembly comprising:

a first deck;

a second deck having a plurality of column mounting areas, the second deck further including an upper surface with a plurality of molded pockets alternating with molded protrusions between the column mounting area the pockets and protrusions respectively forming corresponding protrusions and pockets, on a lower surface of the second deck, each of the plurality of molded pockets on the upper surface defining a corresponding one of the plurality of protrusions on the lower surface and each of the plurality of molded protrusions on the upper surface defining a corresponding one of the plurality of pockets on the lower surface; and a plurality of columns between the first deck and the second deck.

13. The pallet assembly according to claim 12 further including:

a first reinforcement member between the first deck and the plurality of columns; and a second reinforcement member between the second deck and the plurality of columns, the second reinforcement member received within a channel defined between the protrusions and pockets in the second deck.

14. The pallet assembly according to claim 13 further including a tapered rail extending about a periphery of the second deck outward of the pockets and the protrusions.

15. In combination:

a rack having a pair of ledges extending inwardly toward one another, opposing inner edges of the ledges spaced apart by a first distance; and a reinforced pallet having a first deck and a plurality of supports extending from the first deck, the first deck supported at opposite edges by the pair of ledges of the rack, the first deck including a reinforcement member, a length of the reinforcement member extending across the first deck to positions adjacent each ledge, wherein the length of the reinforcement member is less than the first distance between the pair of ledges.

16. The combination of claim 15 wherein the deck and the reinforcement member are different materials.

17. The combination of claim 15 wherein the deck is plastic and the reinforcement member is metal.

* * * * *